US006006541A

United States Patent [19]

Taylor

[11] Patent Number: 6,006,541

[45] Date of Patent: Dec. 28, 1999

[54] REFRIGERATION EFFICIENCY IMPROVEMENT BY REDUCING THE DIFFERENCE BETWEEN TEMPERATURES OF HEAT REJECTION AND HEAT ABSORPTION

[76] Inventor: Christopher Taylor, 4209 Province Dr., Wilmington, N.C. 28405

[21] Appl. No.: 08/288,914

[22] Filed: Aug. 11, 1994

Related U.S. Application Data

[63] Continuation of application No. 08/072,391, Jun. 7, 1993.

[51] Int. Cl.[6] ..... F25D 19/00; F25B 39/02; F25B 27/00; F28F 3/12

[52] U.S. Cl. ..... 62/453; 62/516; 62/518; 62/238.6; 62/238.7; 165/53; 165/169

[58] Field of Search ..... 62/452, 453, 516, 62/517, 323, 238.6, 238.7, 259.1, 263, 335, 518; 165/168, 169, 47, 50, 53–54

[56] References Cited

U.S. PATENT DOCUMENTS

| | | | |
|---|---|---|---|
| 899,231 | 9/1908 | Nopenz | 165/169 |
| 2,167,394 | 7/1939 | Smith | 62/523 |
| 2,356,778 | 8/1944 | Morrison | 62/453 |
| 2,356,781 | 8/1944 | Morrison | 62/452 |
| 3,122,006 | 2/1964 | Jacobs | 62/453 |
| 3,209,547 | 10/1965 | Elfving | 165/169 |
| 3,902,332 | 9/1975 | Torcomian | 62/451 |
| 4,149,389 | 4/1979 | Hayes et al. | 62/79 |
| 4,391,104 | 7/1983 | Wendschlag | 62/79 |

OTHER PUBLICATIONS

Ashrae Handbook 1985 Fundamentals, American Society of Heating, Refrigerating and Alr Conditioning Engineers, Inc., Atalnta GA 30329, Table 10, p. 16.10.

*Primary Examiner*—William Doerrler

[57] ABSTRACT

The surroundings heat exchanger envelops an enclosure's insulation so that it exchanges part of its heat load directly through the enclosure, instead of indirectly with the surroundings which would then exchange an equal amount of heat with the enclosure. This reduces the temperature differentials required to drive heat a transfer because little heat remains to be transferred by the indirect path. This is augmented, in some cases, either by exchanging heat with media other than gas, comprising conductive solids or liquids, natural or forced convective liquid systems, or phase change systems comprising thermal storage or combination refrigeration/heat-pumping systems or combining the heat supplier of a refrigeration system with the heat absorber of a heat pumping system; or by avoiding unnecessarily high temperatures when pumping heat into hot water systems by either or both of the following means: regulating temperatures at lower set points or zoning heat pumps according to user need, which improves efficiency significantly, when heat is provided by heat pump, as it does not when heat is provided by electric resistance heating or combustion of fossil fuel.

27 Claims, 7 Drawing Sheets

DIRECT UNION OPTION

REFRIGERATION EFFICIENCY IMPROVEMENT BY REDUCING THE DIFFERENCE BETWEEN TEMPERATURES OF HEAT REJECTION AND HEAT ABSORPTION

REFERENCES TO RELATED APPLICATIONS

This application is a continuation of the application with Ser. No. 08/072,391 which was filed on Jun. 7, 1993. The earlier filing date of this application is hereby claimed. A preliminary amendment is enclosed.

0. Definitions Used

Refrigeration System: Can Also Include Heat Pumps And Combination Refrigeration And Heat Pump Systems. Refrigerator: Can Include The Alternative Appliances, Refrigerator/Freezer Or Freezer, In Appropriate Contexts. Enclosure Heat Exchanger: Heat Absorber In Refrigeration Systems, Heat Supplier In Heat Pumps, Either Or Both In Combination Refrigeration/Heat Pump Systems. Surroundings Heat Exchanger: Heat Supplier In Refrigeration Systems, Heat Absorber In Heat Pumps. Heat Absorber: Evaporating Refrigerant In Vapor Compression Systems And Absorption Systems, Cold Junction In Solid State Systems. Heat Supplier: Condensing Refrigerant In Vapor Compression Systems and Absorption Systems, Hot Junction In Solid State Systems.

BACKGROUND OF THE INVENTION

1. Field of the Invention

The present invention relates to Refrigeration, and specifically to reducing costs, by increasing the effectiveness of Surroundings Heat Exchangers and by more efficiently recovering reject heat for water heating.

2. Prior Art

Refrigeration Systems are used for maintaining the contents of enclosed spaces, which are separated from their surroundings by the enclosing walls, at depressed or elevated temperatures. In some cases the functions of refrigeration and heat pumping are combined to keep the contents of one or more enclosed spaces at depressed temperatures while also keeping the contents of one or more other enclosed spaces at elevated temperatures. The objective is frequently to delay deterioration of the contents of the enclosed space, to maintain enclosed spaces at comfortable temperatures for occupation by humans or other animals, or to adjust the temperature of materials in preparation for use. In the past said contents of said enclosed spaces have been maintained, at the desired temperatures, using Surroundings Heat Exchangers, maintained at temperatures greater (in the case of refrigeration systems) and less (in the case of heat pumping systems) than those of the surroundings immersed in the surroundings, which exchange heat with said surroundings. Said heat transfer is required to counteract heat which is transferred (by conduction, convection or radiation) through the enclosing walls, which are normally insulated, in addition to heat transferred along with material exchanged between the surrounding space and the enclosed space and heat generated or absorbed within the enclosed space (e.g. by chemical reaction or electric heater). Frequently the surroundings comprise gasses, such as air, and said heat is frequently exchanged between the Surroundings Heat Exchangers and said gasses. The heat transfer coefficients between solid heat exchange surfaces, and gasses are very low, as is well known to workers in the heat transfer field. Since the heat flow rate is approximately proportional to the product of said coefficient, the heat exchange area, and the temperature differential, it is necessary to maintain a large temperature differential in order to drive the heat exchange between Surroundings Heat Exchangers and gaseous surroundings. The alternative of providing large heat transfer surfaces is limited by cost and available space. The maintenance of said large temperature differentials, for heat transfer, results in large differences between the temperatures of the Heat Supplier and the Heat Absorber of the Refrigeration System. As is well known to workers in the field of refrigeration, the efficiency of Refrigeration Systems increase as said temperature differences decrease. Consequently the maximum achievable efficiency of the Refrigeration System is adversely affected by the fact that the heat load must be transferred between said gas and said Surroundings Heat Exchanger. Typical residential refrigerators operate with heat supplier temperatures about 50° F. above the temperature of the surroundings. Previous efforts to reduce the effect, of said low heat transfer coefficients, on efficiency, comprise those described in the "Prior Art" section of my application Ser. No. 08/030,734 filing date Mar. 6, 1993, as well as the Enclosure Heat Exchanger improvements disclosed in said application. Reject heat from residential type air conditioning is used for residential type water heating in commercially available equipment. This practice, although beneficial, is of limited value because the real time supply of waste reject heat from air conditioning systems is typically poorly correlated with the real time demand for heat for water heating. The use of reject heat from residential type refrigerators for residential type water heating, has been described in my application Ser. No. 08/030,734 filing date Mar. 6, 1993. The rationale for that invention includes improved efficiency, due partly to reduced temperature differences between heat supplier and absorber, substantially to the minimum temperature difference at which the insulated enclosure, the heat absorber or heat supplier, comprising given largely enveloping construction, could maintain a given space at a given temperature, within given surroundings at given temperature, in the absence of other heat absorber or heat supplier, (made possible by enveloping heat exchangers or avoidance of, notoriously poor, gas side heat transfer characteristics, or both), but other important factors comprise; the typical good match, in both quantity and temperature, between the reject heat available and the heat required for water heating; the typical proximity of the two appliances involved; and excellent real time correlation between supply and demand. Although the above referenced contributions have improved the performance of refrigeration systems, and in some cases have increased efficiency, or in other ways reduced operating costs, none of them have achieved or fulfilled the objectives of the present invention; one of which is to reduce operating costs, by reducing the temperature difference between the Surroundings Heat Exchanger and the Enclosure Heat Exchanger, by reducing the temperature differentials required for heat transfer, by use of Enveloping Surroundings Heat Exchangers; and the second of which is to improve the efficiency of water heating heat pumps by segregating the water either by the heat pump zone or by both the heat pump zone and the usage stream.

SUMMARY OF THE INVENTION

One objective of the present invention is to increase the efficiency of Refrigeration Systems by reducing the difference between the operating temperature of the Heat Supplier and the operating temperature of the Heat Absorber, said reduction in temperature difference being achieved; by reducing the temperature differentials, required to drive heat transfer between the Surroundings Heat Exchanger and the surroundings; which is achieved by shaping and positioning said Surroundings Heat Exchanger so as to envelop or largely envelop the enclosure's insulation. The primary benefit of said feature is that those parts of the heat load, which are transferred (by conduction, convection or radiation) through the enclosing walls, are exchanged directly, thus reducing the amount of heat which must be transferred between the surroundings and the Surroundings Heat Exchanger. The secondary benefit of said feature, is the provision of additional, relatively inexpensive and unobtrusive, heat transfer surface between the surroundings and the Surroundings Heat Exchanger, said heat transfer surface being rendered relatively inexpensive and unobtrusive because the heat transfer material can also serve as part of the enclosing wall. A second objective is to improve the efficiency of water heating heat pumps by segregating the water either by heat pump zones or by both heat pump zones and the usage streams.

DETAILED DESCRIPTION

Preferred Embodiments

Figure 1:
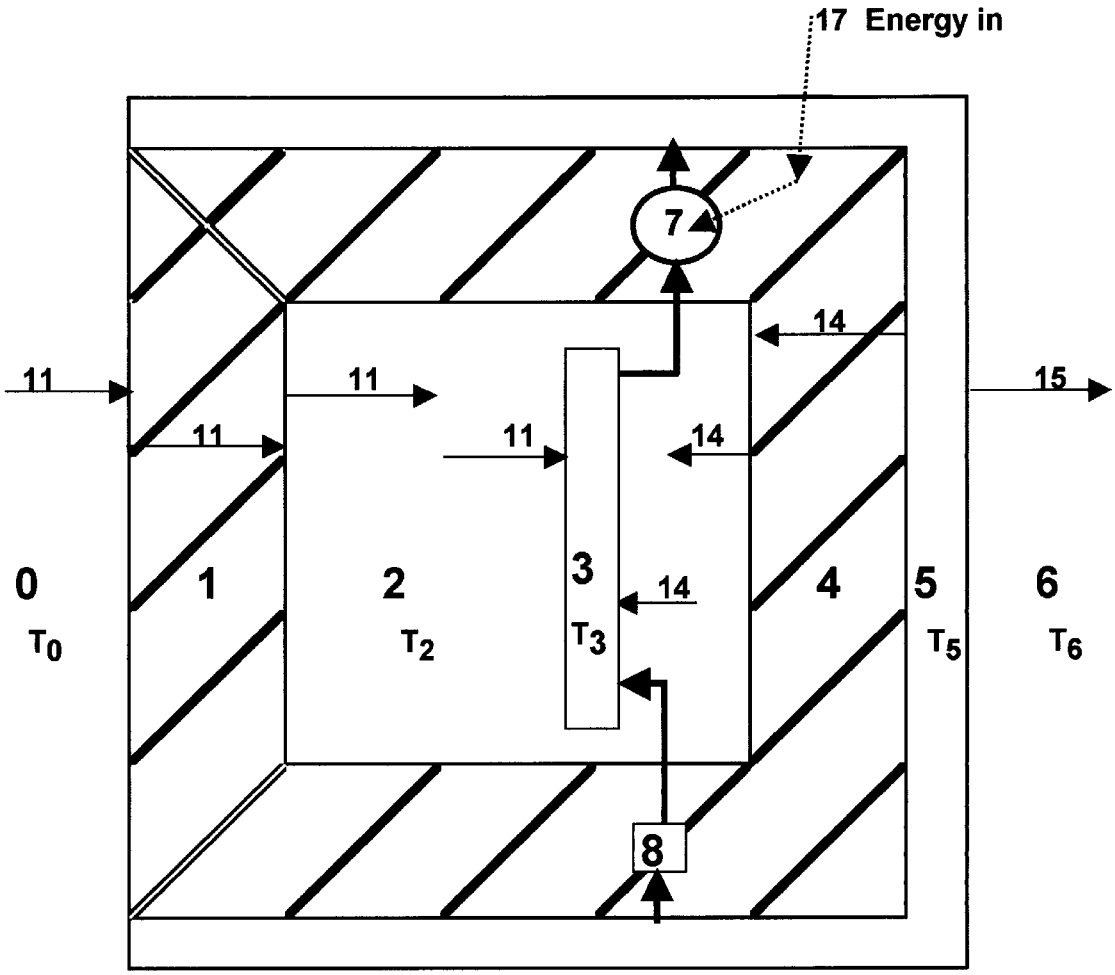
FIG. 1 Refrigeration System Having: Enveloping Surroundings Exchanger And Immersed Enclosure Exchanger FIG. 2 Refrigeration System Having: Enveloping Surroundings Exchanger And Enveloping Enclosure Exchanger FIG. 3 Heat Pumping System Having: Enveloping Surroundings Exchanger And Immersed Enclosure Exchanger FIG. 4 Heat Pumping System Having: Enveloping Surroundings Exchanger And Enveloping Enclosure Exchanger FIG. 5 Simultaneous (more-or-less) Combination Refrigeration and Heat Pumping System Having: heat transfer option FIG. 6 Simultaneous (more-or-less) Combination Refrigeration and Heat Pumping System Having: direct union option FIG. 7 Separate Systems Improvement To The Combination System For Using Reject Heat From Refrigerators For Heating Water.
Figure 2:
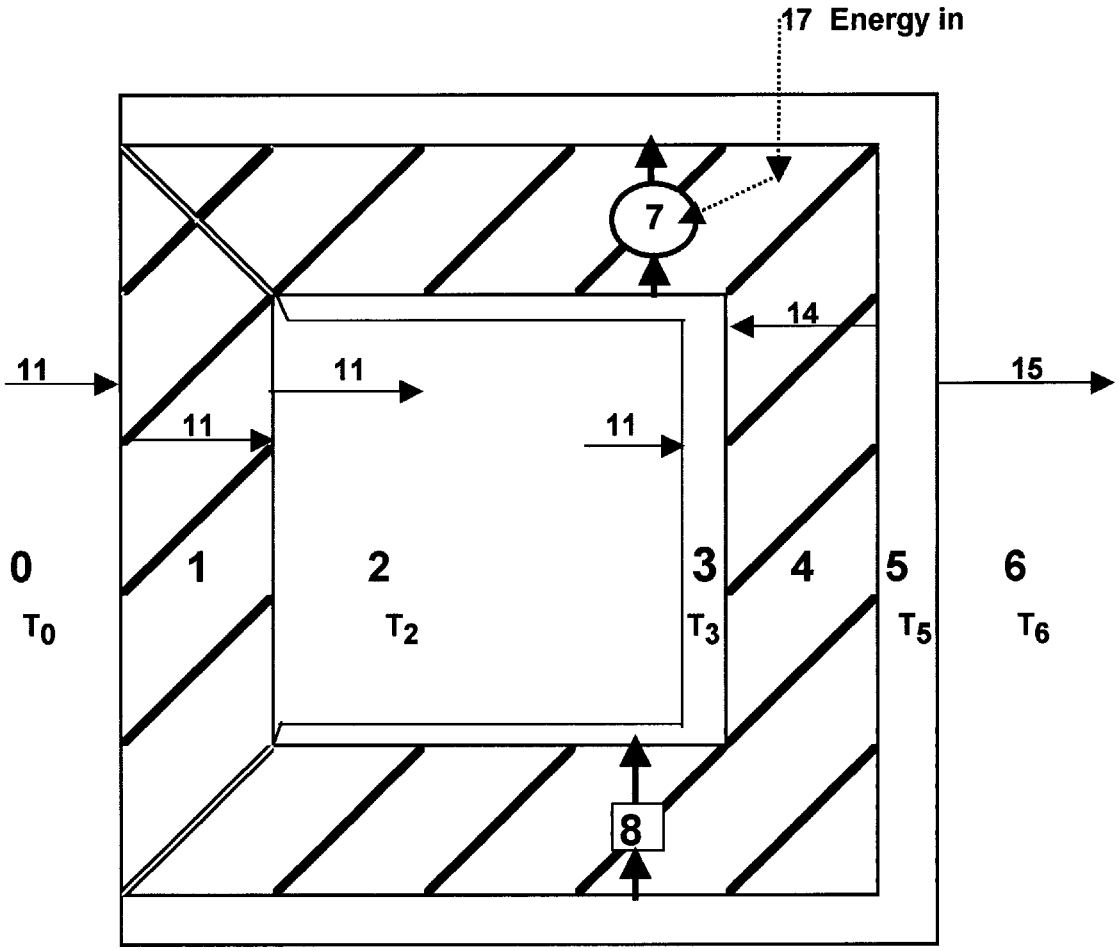

Preferred Embodiment 1 As shown in FIGS. 1 and 2 the present invention includes improvements; to the refrigeration process, by which the contents of an enclosed space are maintained at a depressed temperature; said IMPROVEMENT COMPRISING CONSTRUCTION OF THE SURROUNDINGS HEAT EXCHANGER SO AS TO ENVELOP, OR LARGELY ENVELOP, THE ENCLOSURE'S INSULATION, instead of as a heat exchanger immersed in the surroundings, which increases the efficiency of a said refrigeration process; due to the reduced difference between the operating temperatures of said Surroundings Heat Exchanger and the Enclosure Heat Exchanger; afforded by the reduction in temperature differential, required to drive the transfer of heat to said surroundings from said Surroundings Heat Exchanger; permitted by the reduction in the amount of heat needing to be so transferred, because said enveloping, or largely enveloping, Surroundings Heat Exchanger directly supplies much of the heat passing through said insulation (by means comprising conduction, convection or radiation), said directly supplied heat then not contributing to that which is transferred to said surroundings from said Surroundings Heat Exchanger or to that which is transferred to said contents of said enclosed space from said surroundings, and/or permitted by the relatively inexpensive, and unobtrusive, increase in heat transfer surface between said Surroundings Heat Exchanger and said surroundings, afforded by said enveloping, or largely enveloping, Surroundings Heat Exchanger, being integral with the outer shell of said enclosure, if so desired and further comprising the effecting of said reduced temperature difference, substantially as afforded by said largely enveloping construction, between the operating temperatures of said Surroundings Heat Exchanger and the Enclosure Heat Exchanger, by methods comprising either equipping the refrigerating means, being the motivating device in said refrigeration process, to operate almost continuously and at rates which do not substantially exceed the minimum necessary to accomplish the design requirement or by application of heat sinks in thermal communication with the Surroundings Heat Exchanger or the Enclosure Heat Exchanger, so as to allow the slow heat transfer processes between solid surfaces and gaseous media to proceed almost continuously even when the motivating device operates at unnecessarily high rates and in intermittent mode. Examples of such methods include: In vapor or gas compression systems; equipping the compressor to run at volumetric suction displacement rates which do not unnecessarily exceed those needed to accomplish the design requirements, such as avoiding oversizing of fixed capacity compression systems for on/off control or providing variable capacity compression systems in variable control. In absorption systems; equipping the heater to run at rates which do not unnecessarily exceed those needed to accomplish the design requirements, such as avoiding oversizing of fixed capacity heaters for on/off control or providing variable capacity heaters in variable control. In thermoelectric systems; equipping the couples to run at e.m.f's which do not unnecessarily exceed those needed to accomplish the design requirements, such as avoiding overrating of fixed e.m.f. banks of couples for on/off control or providing variable e.m.f. in variable control. Heat sinks may comprise either robust constructions such as very heavy heat exchanger walls, alternative heat accumulators such as water or alternative forms of energy accumulaters such as phase change media such as water/ice, Glauber's salt or wax. In each case an objective is to provide sufficient heat, or equivalent energy, storage capacity to keep the heat transfer surfaces in thermal communication with gaseous media at more or less constant temperatures. Impediments to heat transfer between the heat sink and the heat exchanger must be avoided to facilitate accomplishment of a further objective which is to keep the heat absorber or heat supplier at more or less a constant temperatures whether the motivating device is running or not. Applications for the present invention are numerous and include appliances or structures such as refrigerators, freezers, refrigerator/freezers or cold storage buildings for the storage of food, medical materials, analytical samples, garments, works of art or other materials which deteriorate less readily at depressed temperatures than at ambient temperatures. Applications also include the maintenance of depressed temperatures in living, working or other spaces occupied by humans or other animals when the comfort or well being of said occupants is enhanced by maintenance of said depressed temperatures. Applications also include the cooling of materials in preparation for use. Typically domestic refrigerators are required to maintain temperatures (T2) inside the enclosure at about 33 to 38° F. when surrounding air temperatures (T0) are at about 68 to 78° F. Typically domestic freezers are required to maintain temperatures inside the enclosure (T2) at about 0 to 5° F. when surrounding air temperatures (T0) are at about 68 to 78° F. Typically residential air conditioning systems are required to maintain temperatures inside the enclosure (T2) at about 68 to 78° F. when surrounding air temperatures (T0) are at about 68 to 120° F., although the wide range of ambient conditions, refrigeration systems, and design options can result in substantially different operating ranges. The surroundings comprise material outside of the enclosure. In some cases the Surroundings Heat Exchanger may exchange heat with parts of the surroundings 6 which are essentially the same as those 0 which exchange heat witt the contents of the enclosed space. In other cases the Surrounding's Heat Exchanger may exchange heat with parts of the surroundings 6 which are not the same as those 0 which exchange heat with the contents of the enclosed space. Segregated parts of the surroundings may comprise heat sinks or sources such as thermal storage systems, liquids such as bodies or streams of water, solids such as the ground, waste streams, gasses such as the atmosphere, or remote sources of radiant heat such as the sun. T0 and T6 may be equal or unequal.

Preferred Embodiment Number 1.1. As shown in FIG. 1 the present invention includes an improvement; to the refrigeration process, in accordance with Embodiment Number 1, in which said Enclosure Heat Exchanger is of the conventional immersed type. Heat 11 is transferred, from the surroundings 0, which are at temperature T0, to the contents of the enclosed space 2, which are maintained at depressed temperature T2, through unenveloped parts of the enclosure 1, such as doors or windows. The driving force for this heat transfer is the temperature differential (T0–T2). Heat 14 is transferred, from the enveloping Surroundings Heat Exchanger 5, which is maintained at elevated temperature T5, to the contents of the enclosed space 2, which are maintained at depressed temperature T2, through enveloped parts of the enclosure 4, such as insulated walls. The driving force for this heat transfer is the temperature differential (T5–T2). Heats 11 and 14 are transferred, from the contents of the enclosed space 2 to the immersed Enclosure Heat Exchanger 3 which is maintained at depressed temperature T3. The driving force for this heat transfer is the temperature differential (T2–T3). Heat 15 is transferred, from the enveloping Surroundings Heat Exchanger 5, which is maintained at elevated temperature T5, to the surroundings 6, which are at temperature T8. a The driving force for this heat transfer is the temperature differential (T5–T6). Energy 17, is supplied to the refrigeration system to maintain the temperature difference (T5–T3), between the enveloping Surroundings Heat Exchanger 5 and the immersed Enclosure Heat Exchanger 3.

Preferred Embodiment Number 1.2. As shown in FIG. 2 the present invention includes an improvement; to the refrigeration process, in accordance with Embodiment Number 1, in which said Enclosure Heat Exchanger is of the enveloping type disclosed in claim 1 of my application Ser. No. 08/030, 734 filing date Mar. 12, 1993. Heat 11 is transferred, from the surroundings 0, which are at temperature T0, to the contents of the enclosed space 2, which are maintained at depressed temperature T2, through unenveloped parts of the enclosure 1, such as doors or windows. The driving force for this heat transfer is the temperature differential (T0–T2). Heat 14 is transferred, from the enveloping Surroundings Heat Exchanger 5, which is maintained at elevated temperature T5, to the enveloping Enclosure Heat Exchanger 3, which is maintained at depressed temperature T3, through enveloped parts of the enclosure 4, such as insulated walls. The driving force for this heat transfer is the temperature differential (T5–T3). Heat 11 is transferred, from the contents of the enclosed space 2 to the enveloping Enclosure Heat Exchanger 3 which is maintained at depressed temperature T3. The driving force for this heat transfer is the temperature differential (T2–T3). Heat 15 is transferred, from the enveloping Surroundings Heat Exchanger 5, which is maintained at elevated temperature T5, to the surroundings 6, which are at temperature T6. The driving force for this heat transfer is the temperature a differential (T5–T6). Energy 17, is supplied to the refrigeration system to maintain the temperature difference (T5–T3), between the enveloping Surroundings Heat Exchanger 5 and the enveloping Enclosure Heat Exchanger 3.

Preferred Embodiment Number 1.3. The present invention includes the improvements of embodiment number 1 in which the functions of shell and Surroundings Heat Exchanger are integrated in dual purpose components, either partially or completely, for reasons comprising cost containment, space utilization or efficiency.

Preferred Embodiment Number 1.4. The present invention includes the improvements of embodiment number 1 in which the functions of shell and Surroundings Heat Exchanger may be performed by separate components, for reasons comprising puncture prevention, hygiene, aesthetics, protection of materials of construction, or heat transfer enhancement.

Figure 3:
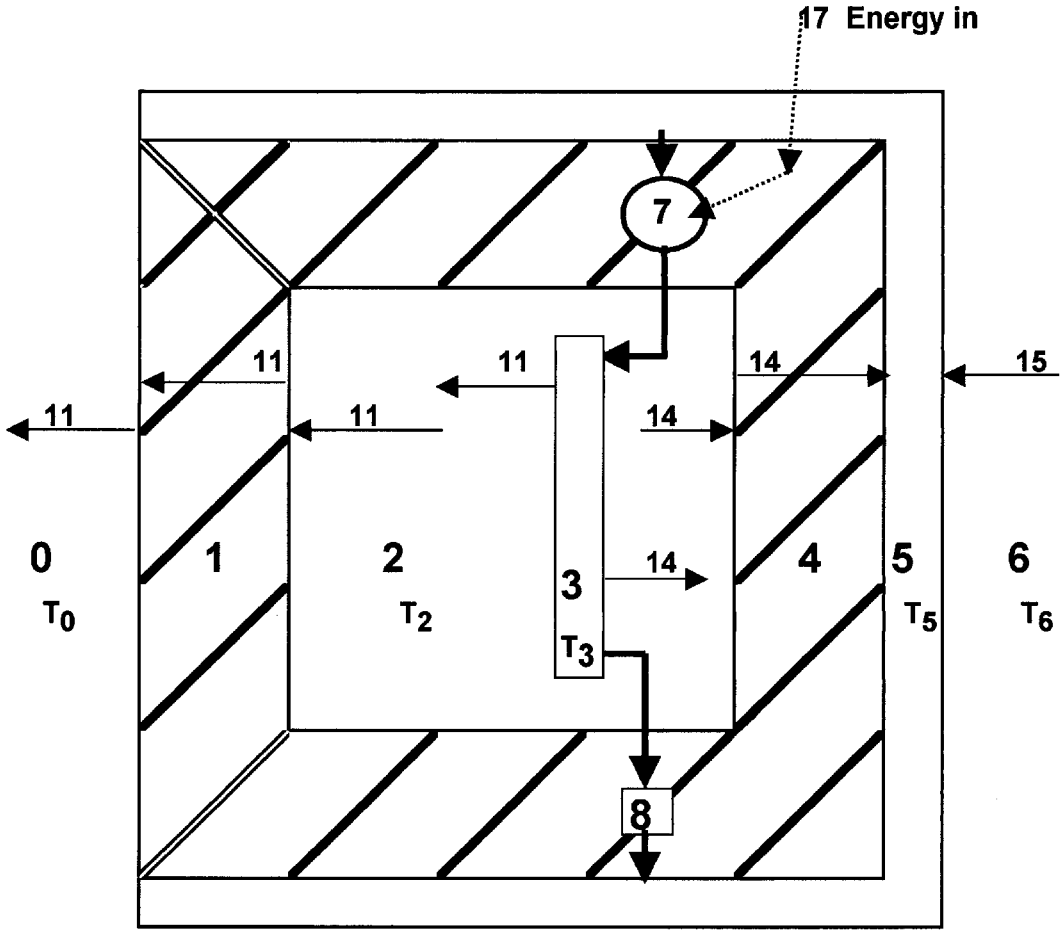
Figure 4:
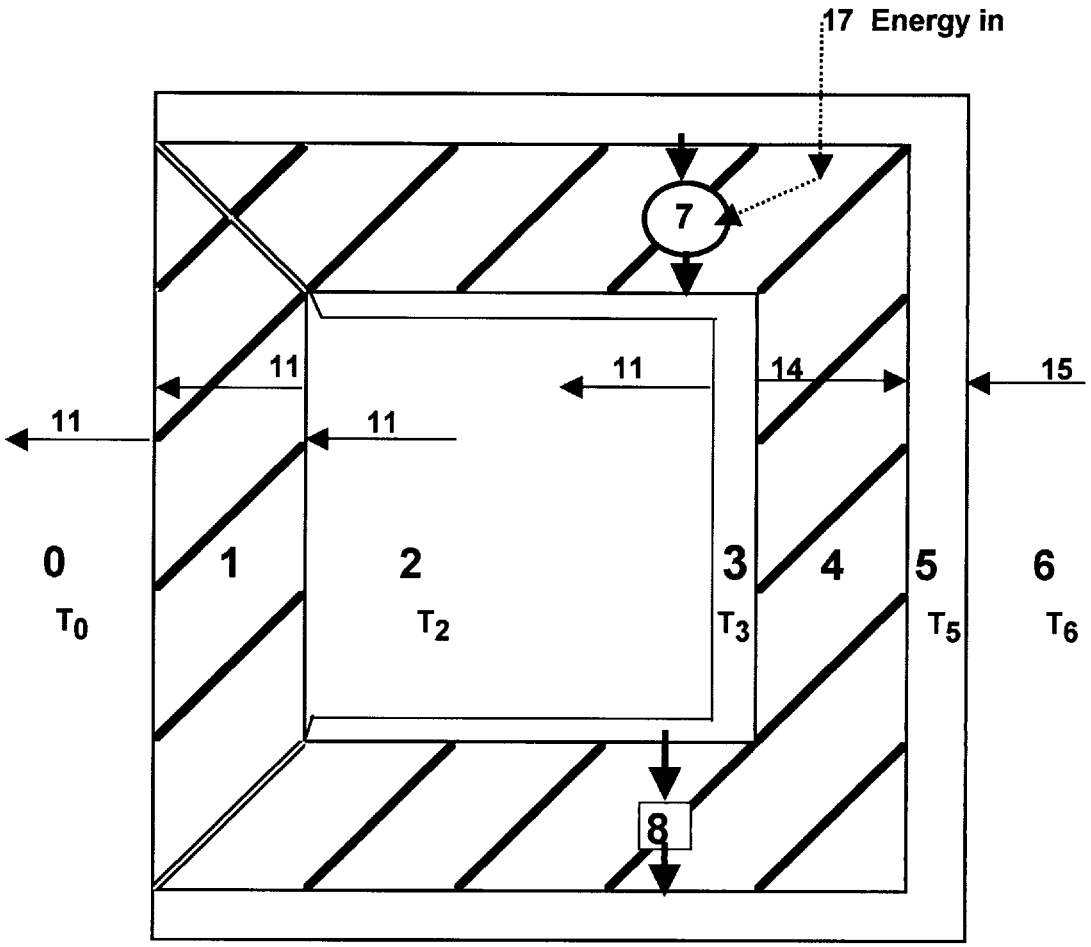

Preferred Embodiment Number 2 As shown in FIGS. 3 and 4 the present invention includes improvements; to the heat pumping process, by which the contents of an enclosed space are maintained at an elevated temperature; said IMPROVEMENT COMPRISING CONSTRUCTION OF THE SURROUNDINGS HEAT EXCHANGER SO AS TO ENVELOP, OR LARGELY ENVELOP, THE ENCLOSURE'S INSULATION, instead of as a heat exchanger immersed in the surroundings, which increases the efficiency of said heat pumping process; due to the reduced difference between the operating temperatures of the Enclosure Heat Exchanger and said Surroundings Heat Exchanger; afforded by the reduction in temperature differential, required to drive the transfer of heat from said surroundings to said Surroundings Heat Exchanger; permitted by the reduction in the amount of heat needing to be so transferred, because said enveloping, or largely enveloping, Surroundings Heat Exchanger intercepts much of the heat escaping to through said insulation (by means comprising conduction, convection or radiation), said intercepted heat then not contributing to that which is transferred from said surroundings to said Surroundings Heat Exchanger or to that which is transferred from said contents of said enclosed space to said surroundings, and/or permitted by the relatively inexpensive, and unobtrusive, increase in heat transfer surface between said surroundings and said Surroundings Heat Exchanger, afforded by said enveloping, or largely enveloping, Surroundings Heat Exchanger being integral with the outer shell of said enclosure, if so desired. Applications for the present invention are numerous and include appliances or structures for the storage of materials, which deteriorate less readily at elevated temperatures than at ambient temperatures. Applications also include the maintenance of elevated temperatures in living, working or other spaces occupied by humans or other animals when the comfort or well being of said occupants is enhanced by maintenance of said elevated temperatures. Applications also include the heating of materials in preparation for use. Typically residential heat pumps are required to maintain temperatures inside the enclosure (T2) at about 68 to 78° F. when surrounding air temperatures (T0) are at about 35 to 65° F., although the wide range of ambient conditions, refrigeration systems, and design options can result in substantially different operating ranges. The surroundings comprise material outside of the enclosure. In some cases the Surroundings Heat Exchanger may exchange heat with parts of the surroundings 6 which are essentially the same as those 0 which exchange heat with the contents of the enclosed space. In other cases the Surroundings Heat Exchanger may exchange heat with parts of the surroundings 6 which are not the same as those 0 which exchange heat with the contents of the enclosed space. Segregated parts of the surroundings may comprise heat sinks or sources such as thermal storage systems, liquids such as bodies or streams of water, solids such as the ground, waste streams, gasses such as the atmosphere, or remote sources of radiant heat such as the sun. T0 and T6 may be equal or unequal.

Preferred Embodiment Number 2.1. As shown in FIG. 3 the present invention includes an improvement; to the heat pumping process, in accordance with Embodiment Number 2, in which said Enclosure Heat Exchanger is of the conventional immersed type. Heat 11 is transferred, to the surroundings 0, which are at temperature T0, from the contents of the enclosed space 2, which are maintained at elevated temperature T2, through unenveloped parts of the enclosure 1, such as doors or windows. The driving force for this heat transfer is the temperature differential (T2–T0). Heat 14 is transferred, to the enveloping Surroundings Heat Exchanger 5, which is maintained at depressed temperature T5, from the contents of the enclosed space, which are maintained at elevated temperature T2, through enveloped parts of the enclosure 4, such as insulated walls. The driving force for this heat transfer is the temperature differential (T2–T5). Heats 11 and 14 are transferred, to the contents of the enclosed space 2 from the immersed Enclosure Heat Exchanger 3 which is maintained at elevated temperature T3. The driving force for this heat transfer is the temperature differential (T3–T2). Heat 15 is transferred, to the enveloping Surroundings Heat Exchanger 5, which is maintained at depressed temperature T5, from the surroundings 6, which are at temperature T6. The driving force for this heat transfer is the temperature differential (T6–T5). Energy 17, is supplied to the refrigeration system to maintain the temperature difference (T3–T5), between the immersed Enclosure Heat Exchanger 3 and the enveloping Surroundings Heat Exchanger 5.

Preferred Embodiment Number 2.2. As shown in FIG. 4 the present invention includes an improvement; to the heat pumping process, in accordance with Embodiment Number 2, in which said Enclosure Heat Exchanger is of the enveloping type disclosed in claim 1 of my application Ser. No. 08/030,734 filing date Mar. 12, 1993. Heat 11 is transferred, to the surroundings 0, which are at temperature T0, from the contents of the enclosed space 2, which are maintained at elevated temperature T2, through unenveloped parts of the enclosure 1, such as doors or windows. The driving force for this heat transfer is the temperature differential (T2–T0). Heat 14 is transferred, to the enveloping Surroundings Heat Exchanger 5, which is maintained at depressed temperature T5, from the enveloping Enclosure Heat Exchanger 3, which is maintained at elevated temperature T3, through enveloped parts of the enclosure 4, such as insulated walls. The driving force for this heat transfer is the temperature differential (T3–T5). Heat 11 is transferred, to the contents of the enclosed space 2 from the enveloping Enclosure Heat Exchanger 3 which is maintained at elevated temperature T3. The driving force for this heat transfer is the temperature differential (T3–T2). Heat 15 is transferred, to the enveloping Surroundings Heat Exchanger 5, which is maintained at depressed a temperature T5, from the surroundings 6, which are at temperature T6. The driving force for this heat transfer is the temperature differential (T6–T5). Energy 17, is supplied to the refrigeration system to maintain the temperature difference (T3–T5), between the enveloping Enclosure Heat Exchanger 3 and the enveloping Surroundings Heat Exchanger 5.

Preferred Embodiment Number 2.3. The present invention includes the improvements of embodiment number 2 in which the functions of shell and Surroundings Heat Exchanger are integrated in a dual purpose component, either partially or completely, for reasons comprising cost containment, space utilization or efficiency.

Preferred Embodiment Number 2.4 The present invention includes the improvements of embodiment number 2 in which the functions of shell and Surroundings Heat Exchanger may be performed by separate components, for reasons comprising puncture prevention, hygiene, aesthetics, protection of materials of construction, or heat transfer enhancement.

Figure 5:
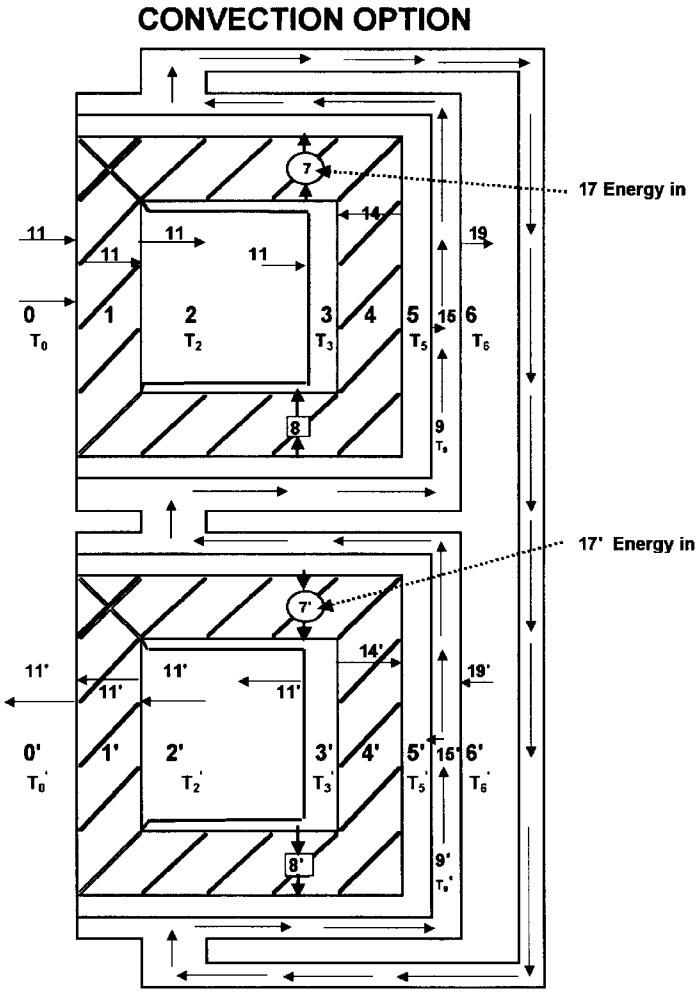
Figure 5:
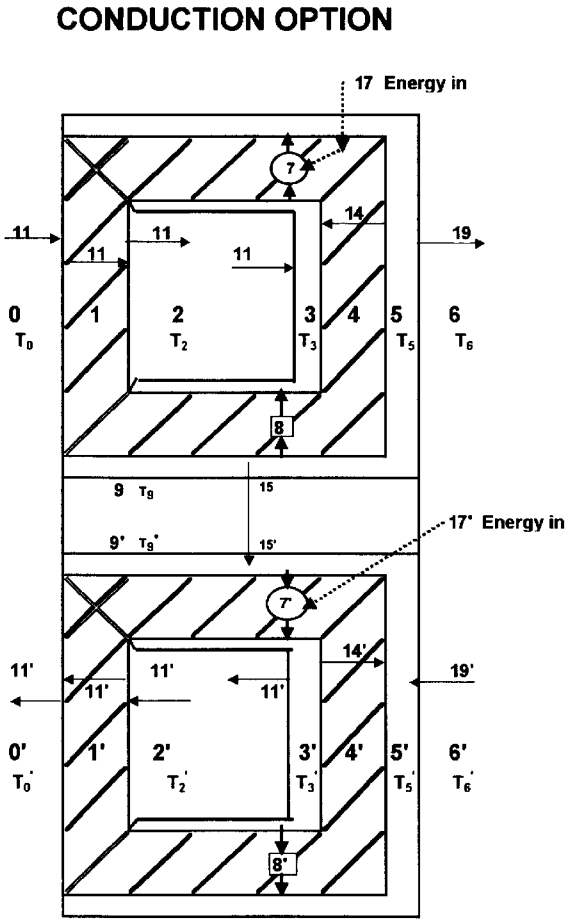
Figure 6:
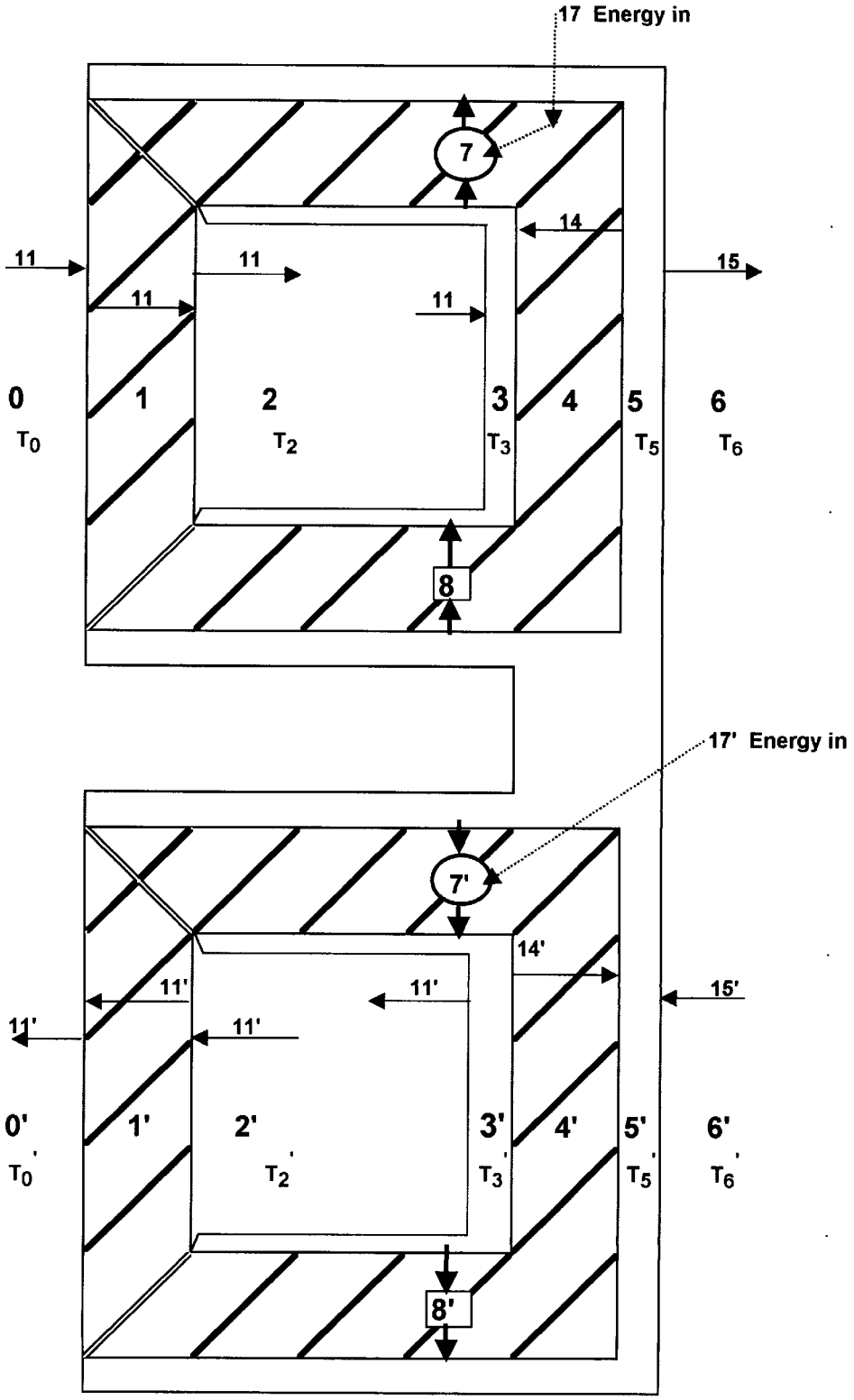

Preferred Embodiment Numbers 2.5. As shown in FIGS. 5 and 6 the present invention includes a combination of the improvements of embodiments 1 and 2, in which a refrigeration system's heat supplier is thermally connected to the heat absorber of a heat pump, so that the rejected heat from the refrigeration system's heat supplier can be absorbed, more-or-less simultaneously, by the heat pumping system's heat absorber, which further reduces the quantities of heat which must be exchanged between the surroundings and the refrigeration systems. In both drawings, all of the heat exchangers are depicted as being of the enveloping type, disclosed in my application Ser. No. 08/030,734 filing date Mar. 12, 1993, but a the present invention also includes constructions in which some or all of the enclosure heat exchangers may be of the immersion type.

Preferred Embodiment Number 2.5.1 The present invention includes embodiment 2.5, in which the thermal connection is effected by heat transfer between the refrigeration systen's heat supplier and the heat pump's heat absorber. As shown in FIG. 5 Heat 11 is transferred, from the surroundings 0, which are at temperature T0, to the contents of the enclosed space 2, which are maintained at lo depressed temperature T2, through unenveloped parts of the enclosure 1, such as doors or windows. The driving force for this heat transfer is the temperature differential (T0–T2). Heat 14 is transferred, from the enveloping surroundings heat supplier 5, which is maintained at elevated temperature T5, to the enclosure heat absorber 3, which is maintained at depressed temperature T3, through enveloped parts of the enclosure 4 such as insulated walls (and through part of the contents of the enclosed space 2, if the enclosure heat absorber is of the immersed type). The driving force for this heat transfer is the temperature differential (T5–T3). Heat 11 is transferred, from the contents of the enclosed space 2 to the Enclosure Heat Exchanger 3 which is maintained at depressed temperature T3. The driving force for this heat transfer is the temperature differential (T2–T3). Heat 15 is transferred, from the enveloping heat supplier 5, which is maintained at elevated temperature T5, to the heat transfer medium 9, at temperature T9. The driving force for this heat transfer is the temperature differential (T5–T9). In the convection option, Heat 19 is transferred from the heat transfer medium which is maintained at elevated temperature T9, to the surroundings. The driving force a for this heat transfer is the temperature differential (T9–T6). In the conduction option, Heat 19 is transferred from the enveloping heat supplier 5, which is maintained at elevated temperature T5, to the surroundings. The driving force for this heat transfer is the temperature differential (T5–T6). Energy 17, is supplied to the refrigeration system to maintain the temperature difference (T5–T3), between the enveloping heat supplier 5 and the Enclosure Heat Exchanger 3. Heat 15' (Heat 15 less intermediate losses, plus intermediate gains) is conveyed to 5' As is further shown in FIG. 5 Heat 11' is transferred, to the surroundings 0', which are at temperature T0', from the contents of the enclosed space 2', which are maintained at elevated temperature T2', through unenveloped parts of the enclosure 1', such as doors or windows. The driving force for this heat transfer is the temperature differential (T2'–T0'). Heat 14' is transferred, to the enveloping surroundings heat absorber 5', which is maintained at depressed temperature T5', from the Enclosure Heat Exchanger 3', which is maintained at elevated temperature T3', through enveloped parts of the enclosure 4' such as insulated walls (and through part of the contents of the enclosed space 2', if the Enclosure Heat Exchanger is of the immersed type). The driving force for this heat transfer is the temperature differential (T3'–T5'). Heat 11' is transferred, to the contents of the enclosed space 2' from the Enclosure Heat Exchanger 3' which is maintained at elevated temperature T3'. The driving force for this heat transfer is the temperature differential (T3'–T2'). Heat 15 is transferred, to the enveloping heat absorber 5', which is maintained at depressed temperature T5', from the heat transfer medium T9', at temperature T9'. The driving force for this heat transfer is the temperature differential (T9'–T5'). In the convection option, Heat 19' is transferred to the heat transfer medium which is maintained at elevated temperature T9', from the surroundings. The driving force for this heat transfer is the temperature differential (T6'–T9') In the conduction option, Heat 19' is transferred to the enveloping heat supplier 5', which is maintained at elevated temperature T5', from the surroundings. The driving force for this heat transfer is S6 the temperature differential (T6'–T5'). Energy 17', is supplied to the refrigeration system to maintain the temperature difference in (T3'–T5'), between the Enclosure Heat Exchanger 3' and the enveloping heat absorber 5'. The amounts of heat 19 and 19' are relatively small since heats 15 and 15' are mutually exclusive or partially mutually exclusive. Consequently (T9–T8), (T5'T6), (T6'–T5') and (T6'–T9') are relatively small, which allows (T5–T3) and (T3–T5') to be relatively small, resulting in further improved operating efficiency. The means, by which heat 15/15' is transferred through heat transfer medium 5/5', ray comprise conduction, radiation and/or natural or forced convection or other form of combined heat and mass transfer process.

Preferred Embodiment Number 2.5.2 The present invention includes embodiment 2.5, in which the thermal connection is effected by direct union of the refrigeration system's heat supplier and the heat pump's heat absorber. As shown in FIG. 6 Heat 11 is transferred, from the surroundings 0, which are at temperature T0, to the contents of the enclosed space 2, which are maintained at depressed temperature T2, through unenveloped parts of the enclosure 1, such as doors or windows. The driving force for this heat transfer is the temperature differential (T0–T2). Heat 14 is transferred, from the enveloping surroundings heat supplier 5, which is maintained at elevated temperature T5, to the enclosure heat absorber 3, which is maintained at depressed temperature T3, through enveloped parts of the enclosure 4 such as insulated walls (and through part of the contents of the enclosed space 2, if the enclosure heat absorber is of the immersed type). The driving force for this heat transfer is the temperature differential (T5–T3). Heat 11 is transferred, from the contents of the enclosed space to the Enclosure Heat Exchanger 3 which is maintained at depressed temperature T3. The driving force for this heat transfer is the temperature differential (T2–T3). Heat 15 is transferred, from the enveloping heat supplier 5, which is maintained at elevated temperature T5, to the surroundings, which are at temperature T6. The driving force for this heat transfer is the temperature differential (T5–T6). Energy 17, is supplied to the refrigeration system to maintain the temperature difference (T5–T3), between the enveloping heat supplier 5 and the Enclosure Heat Exchanger 3. As is further shown in FIG. 6 Heat 11' is transferred, to the surroundings 0', which are at temperature T0', from the contents of the enclosed space 2', which are maintained at elevated temperature T2', through unenveloped parts of the enclosure 1', such as doors or windows. The driving force for this heat transfer is the temperature differential (T2'–T0'). Heat 14' is transferred, to the enveloping surroundings heat absorber 5', which is maintained at depressed temperature T5', from the Enclosure Heat Exchanger 3', which is maintained at elevated temperature T3', through enveloped parts of the enclosure 4' such as insulated walls (and through part of the contents of the enclosed space 2', if the Enclosure Heat Exchanger is of the immersed type). The driving force for this heat transfer is the temperature differential (T3'–T5'). Heat 11' is transferred, to the contents of the enclosed space 2' from the Enclosure Heat Exchanger 3' which is maintained 1S at elevated temperature T3'. The driving force for this heat transfer is the temperature differential (T3'–T2'). Heat 15' is transferred, to the enveloping heat absorber 5', which is maintained at depressed temperature T5', from the surroundings, which are at temperature T6'. The driving force for this heat transfer is the temperature differential (T6'–T5'). Energy 17', is supplied to the refrigeration system to maintain the temperature difference (T3'–T5'), between the Enclosure Heat Exchanger 3' and the enveloping heat absorber 5'. The amounts of heat 15 and 15' which must be transferred between the Surroundings Heat Exchanger and the surroundings 6 and 6' are relatively small since much of the heat is exchanged within the interconnected Surroundings Heat Exchanger 5/5'. Consequently (T5–T3) and (T3'–T5') are relatively small, resulting in further improved operating efficiency.

Preferred Embodiments Numbers 2.6.1 and 2.6.2 The present invention includes combination of embodiments 1 and 2, as shown in FIGS. 1, 2, 3 and 4, in which a single reversible refrigeration system is used, during some time periods as a refrigerator, to prevent elevation of the temperature of the contents of an enclosed space, and during some other time periods as a heat pump, to prevent depression of the temperature of said contents of said enclosed space.

Preferred Embodiment Number 2.6.1. The present invention includes the improvement of preferred embodiment number 2.6, in which, lo during said refrigeration of said contents of said enclosed space, heat 15 is rejected to the general surroundings 0 (instead of 6); and in which, during said pumping of heat into said contents of said enclosed space, said pumped heat is obtained from said general surroundings 0 (instead of 6).

Preferred Embodiment Number 2.6.2. The present invention includes the improvement of preferred embodiment number 2.6, in which, during said refrigeration of said contents of said enclosed space, heat 15 is supplied to a segregated part of the surroundings, such as a heat storage system 6; and in which, during said pumping of heat into the contents of said enclosed space, said heat is retrieved from said heat storage system 6.

Preferred Embodiment Number 3. The present invention includes alternative uses of my application Ser. No. 08/030,734 filing date Mar. 12, 1993, in which some parts of the contents of a refrigerated enclosed space, being at temperatures which are higher than the temperatures of other parts of said enclosed space, are at temperatures which are not necessarily lower than the temperature of the surroundings; and in which some parts of the contents of a heat pumped enclosed space, being at temperatures which are lower than the temperatures of other parts of said contents of said enclosed space, are at temperatures which are not necessarily higher than the temperature of the surroundings; and in which the contents of a refrigerated enclosed space are not necessarily colder than the immediate surroundings when the refrigeration is used to counteract the net radiant heat entering the enclosure from e remote sources such as the sun. Applications include residential air conditioning, in which the comfort of living humans, being parts of the contents of an enclosed space and being at about 98.4° F., is maintained by maintaining the atmosphere inside the residence at about 88 to 78° F., while the temperature of the surrounding air might be at temperatures greater than, less than, or equal to 98.4° F. Other applications include the air conditioning of living space, in which heat is removed (by refrigeration, even though the atmosphere immediately surrounding the enclosure may be at a lower temperature than that of said contents) from rising above the desired temperature range of about 68° F. to 78° F., radiant heat from the sun being the source of heat flowing into the residence. Also included are applications, comprising the removal of heat from heat generating electrical components or chemical reactions or the cooling of materials in preparation for use, in which those parts of the contents of an enclosed space may be maintained at desired temperatures, or cooled from undesired temperatures by refrigeration even though said temperatures may be higher than the temperature of the surroundings. Also included are applications, comprising the supply of heat to heat absorbing equipment or chemical reactions or the heating of materials in preparation for use, in which those parts of the contents of an enclosed space may be maintained at desired temperatures, or heated from undesired temperatures by heat pump even though said temperatures may be lower than the temperature of the surroundings.

Preferred Embodiment Number 4. The present invention includes the improvements of my application Ser. No. 08/030,734 filing date Mar. 12, 1993 in which the functions of liner and Enclosure Heat Exchanger nay each be performed by separate components instead of by dual purpose components, for reasons comprising puncture prevention, hygiene, aesthetics or containment of stored materials.

Preferred Embodiment Number 5. The present invention includes an improvement to combination refrigeration and heat pumping processes, for recovering reject heat from refrigerators, typical of residential type appliances, to meet hot water demands, typical of residential type requirements; in accordance with the present invention or my application Ser. No. 08/030,734 filing date Mar. 12, 1993; in which THE HOT WATER TEMPERATURE IS SET TO JUST MEET, OR ONLY SLIGHTLY EXCEED, THE MAXIMUM USER DEMAND (120° F. for example, instead of 140° F. for example), thus increasing efficiency by reducing the temperature at which heat is rejected from the refrigeration system. Since the objective is to increase, not decrease, energy efficiency, the reduced operating temperature is to be attained by providing sufficient heat storage capacity to meet substantially maximum demand volume, rather than by discarding surplus heat. For example the water storage tank may be sized to provide the volume of water desired by the user at the temperature desired by the user rather than a smaller volume at a higher temperature for the user to temper by mixing with cooler water.

Figure 7:
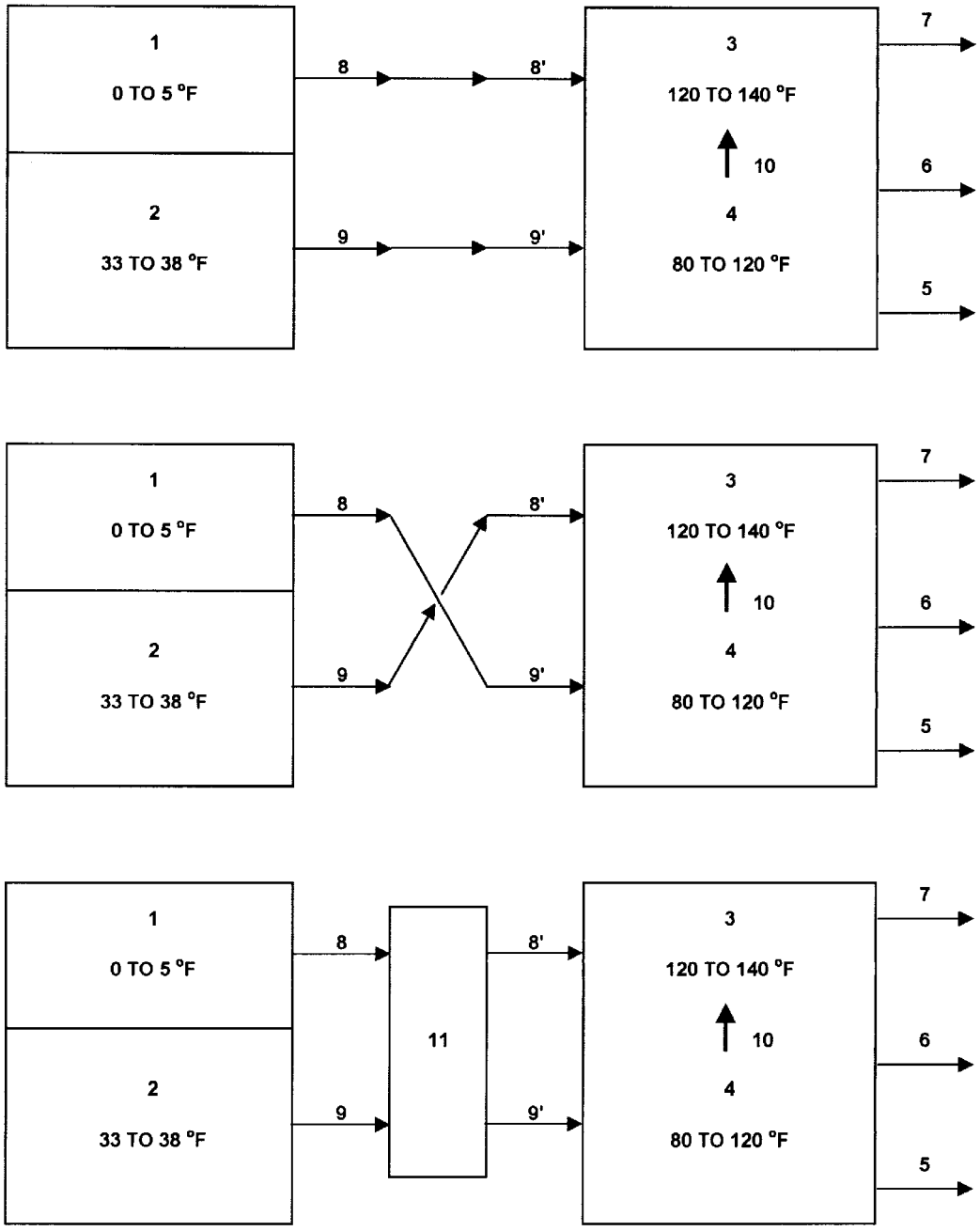

Preferred Embodiment Number 5.1. The present invention includes the improvement of preferred embodiment number 5, in which THE HOT WATER SYSTEM IS SEGREGATED either INTO TWO OR MORE HEAT PUMPING ZONES, or INTO TWO OR MORE HEAT PUMPING ZONES AND TWO OR MORE USAGE STREAMS, WHICH MAY BE OPERATED AT DIFFERENT TEMPERATURES, THE ZONE/STREAM TEMPERATURES BEING SET TO JUST MEET, OR ONLY SLIGHTLY EXCEED, THE MAXIMUM USER DEMANDS FOR THEIR RESPECTIVE ZONE/STREAMS, thus further increasing efficiency by further reducing the temperature at which heat is rejected from one or more of the refrigeration systems. As shown in FIG. 7 heat 8 is rejected from the freezer compartment 1, heat 9 is rejected from the storage cabinet 2, heat 8' is absorbed by the hot water zone 3 and heat 9' is absorbed by the warm water cabinet 4. Unheated water 5 is supplied to the bottom of warm water zone 4, warm water is supplied 6 to users and 10 to the hot water zone 3 and hot water is supplied 7 to users. The freezer 1 is maintained at about 0 to 5° F. The is storage cabinet 2 is maintained at about 33 to 38° F. The hot water zone 3 is maintained at about 120 to 140° F. The warm water zone 4 is maintained at about 80 to 120° F. As shown in details numbers 5.1.1, 5.1.2, and 5.1.3, the reject heat 8 from the freezer 1 may be absorbed as heat 8' by the hot water zone 3 or as heat 9' by the warm water zone 4. Similarly the reject heat 9 from the storage cabinet 2 may be absorbed as heat 8' by the hot water zone 3 or as heat 9' by the warm water zone 4. These processes may be effected by single stage refrigeration/heat-pumping systems, absorbing heat from the refrigerator compartment and supplying heat to the water tank, as described in embodiment 2.6. or my application Ser. No. 08/030,734 filing date Mar. 12, 1993. Alternatively the refrigeration systems may reject heat to an intermediate system 11, from which heat pumps absorb heat as described in embodiment 2.5. The water flows may be continuous in some cases but in many residential type applications will be intermittent, in response to user demands. The warm water stream 6 may be eliminated. The resulting zoned only system (of embodiment number 5), though less energy efficient than the zoned and streamed system (of embodiment number 5.1), is more energy efficient than the single zone systems (of the prior art). Advantages of embodiment number 5 comprise improved efficiency due to reduced temperature difference between heat suppliers and absorbers, reduced problems in controlling shower temperatures, and reduced risks of scalding. Disadvantages comprise the need, in many cases, for more hot water storage capacity, which may increase initial installed cost and require more space. While lower temperatures are of little benefit, when the heat source is electrical resistance heating or combustion, benefits are substantial when heat pumping involved because heat pump efficiency increases as the heat supplier temperature decreases.

General Notes Relating to The Preferred Embodiments Typical temperatures, or temperature ranges, are not intended to be exhaustive. Operation under different conditions is frequently possible, and applications are numerous. The Refrigeration System can be: Either a vapor compression system, in which case the energy input 17 is compression work to compressor 7 (less energy which might be recovered from the expansion device 8) and the heat absorber and supplier are the evaporating refrigerant and the condensing refrigerant respectively; Or an absorption system, in which case the energy input 17 depicts the net effect of heat supplied to the generator 7 and heat removed at the absorber 8, and the heat absorber and supplier are refrigerant evaporating and condensing respectively; Or a solid state system, in which case the energy input 17 depicts the electrical energy supplied to the system, and the heat absorber and supplier are cold and hot junctions respectively. The invention can a also be used with some other types of refrigeration cycle. Said heat absorber and heat supplier are Enclosure Heat Exchanger and the Surroundings Heat Exchanger respectively for refrigeration systems. Said heat absorber and heat supplier are Surroundings Heat Exchanger and the Enclosure Heat Exchanger respectively for heat pumping systems. The foregoing description of the Preferred Embodiments of the invention has been presented for the purposes off illustration and description. It is not intended to be exhaustive or to limit the invention to the precise form disclosed. Many modifications and variations are possible in light of the above is teaching. It is intended that the scope of the invention be limited not by this detailed description, but rather by the claims appended hereto.

I claim:

1. A method for increasing the energy efficiency of a refrigeration system of the type comprising insulated enclosing means; a space, to be maintained at depressed temperatures, and separated from its surroundings by said enclosing means; heat absorber means, on the inside of said enclosing means; heat supplier means, to exchange heat with said surroundings and to be maintained at a temperature which is greater than that of said surroundings; and refrigeration motivating means to depress the temperature of said heat absorber means; energy being supplied to said refrigeration motivating means in order to maintain the temperature difference between said heat supplier means and said heat absorber means wherein the method comprises constructing said heat supplier means to largely envelop said enclosing means and reducing said temperature difference between said heat supplier means and said heat absorber means substantially (as permitted by said largely enveloping heat supplier) to the minimum value whereat said insulated enclosing means; said heat absorber means, on the inside of said enclosing means and said heat supplier means, to exchange heat with said surroundings and constructed to largely envelop said enclosing means; being surrounded by said surroundings at said temperature of said surroundings, in the absence of other heat absorption means and in the absence of other heat supplier means; could maintain said space, separated from its surroundings by said enclosing means, at said depressed temperatures.

2. The improvement of claim 1, in which said heat absorber means are of the conventional immersed type.

3. The improvement of claim 1, in which said heat absorber means are of the enveloping type.

4. The improvements of claim 1 in which said refrigeration system further comprises a shell partially integrated in one dual purpose component with said heat supplier.

5. The improvements of claim 1 in which said refrigeration system further comprises a shell, separate from said heat supplier.

6. A method for increasing the energy efficiency of a heat pumping system of the type comprising insulated enclosing means; a space, to be maintained at elevated temperatures, and separated from its surroundings by said enclosing means; heat supplier means, on the inside of said enclosing means; heat absorber means, to exchange heat with said surroundings; and heat pump motivating means to maintain the temperature of said heat supplier means; energy being supplied to said heat pump motivating means in order to maintain the temperature difference between said heat supplier means and said heat absorber means wherein the method comprises constructing said heat absorber means to largely envelop said enclosing means and reducing said temperature difference between said heat supplier means and said heat absorber means substantially (as permitted by said largely enveloping heat absorber) to the minimum value whereat said insulated enclosing means; said heat supplier means, on the inside of said enclosing means and said heat absorber means, to exchange heat with said surroundings and constructed to largely envelop said enclosing means; being surrounded by said surroundings at said temperature of said surroundings, in the absence of other heat absorption means and in the absence of other heat supplier means; could maintain said space, separated from its surroundings by said enclosing means, at said elevated temperatures.

7. The improvement of claim 6, in which said heat supplier is of the conventional immersed type.

8. The improvement of claim 6, in which said heat supplier is of the enveloping type.

9. The improvements of claim 6 in which said refrigeration system further comprises a shell partially integrated in one dual purpose component with said heat absorber.

10. The improvements of claim 6 in which said refrigeration system further comprises a shell, separate from said heat absorber.

11. A method for increasing the energy efficiency of a combined refrigeration system and heat pumping system of the type comprising insulated enclosing means; a space, to be maintained at depressed temperatures, and separated from its surroundings by said enclosing means; heat absorber means, on the inside of said enclosing means; heat supplier means, thermally connected to said heat pump; further insulated enclosing means; a further space, to be maintained at elevated temperatures and separated from its surroundings by said further enclosing means; further heat supplier means, on the inside of said further enclosing means; further heat absorber means, thermally connected to said refrigeration system's heat supplier; refrigeration motivating means to depress the temperature of said enclosed heat absorber means and heat pump motivating means to maintain the temperature of said enclosed further heat supplier means; energy being supplied to said refrigeration motivating means in order to maintain the temperature difference between said heat supplier means, and said enclosed heat absorber means and to said heat pump motivating means in order to maintain the temperature difference between said enclosed further heat supplier means and said further heat absorber means, wherein the method comprises constructing first said heat supplier means, to largely envelop first said enclosing means; reducing said temperature difference between first said heat supplier means, and first said enclosed heat absorber means substantially (as permitted by said largely enveloping heat supplier) to the minimum value whereat said first enclosing means; said first heat absorber means, on the inside of said first enclosing means and said first heat supplier means constructed to largely envelop said first enclosing means and thermally connected to said heat pump; in the absence of other heat absorption means and in the absence of other heat supplier means; could maintain said first space, separated from its surroundings by said enclosing means, at said depressed temperatures; constructing said further heat absorber means, to largely envelop said further enclosing means and reducing said temperature difference between said further enclosed heat supplier means and said further heat absorber means, substantially (as permitted by said largely enveloping further heat absorber means) to the minimum value whereat said further enclosing means; said further heat supplier means on the inside of said further enclosing means and said further heat absorber means, constructed to largely envelop said further enclosing means and thermally connected to said refrigeration system's heat supplier; in the absence of other heat absorption means and in the absence of other heat supplier means; could maintain said further space, separated from its surroundings by said further enclosing means, at said elevated temperatures; said combined systems being surrounded by said surroundings at said temperature of said surroundings.

12. The improvement of claim 11, in which said heat exchange between said heat supplier means and said further heat absorber means, is effected by heat transfer between said refrigeration system's heat supplier and said heat pump's heat absorber.

13. The improvement of claim 11, in which said heat exchange between said heat supplier and said further heat absorber, is effected by direct union of said refrigeration system's heat supplier and said heat pump's heat absorber.

14. A method for increasing the energy efficiency of a reversible refrigeration system used, during some time periods as a refrigeration system, of the type comprising insulated enclosing means; a space, to be maintained at depressed temperatures, and separated from its surroundings by said enclosing means; heat absorber means, on the inside of said enclosing means; heat supplier means, to exchange heat with said surroundings(and to be maintained at a temperature which is greater than that of said surroundings;) and refrigeration motivating means to depress the temperature of said heat absorber means; energy being supplied to said refrigeration motivating means in order to maintain the temperature difference between said heat supplier means and said heat absorber means and during some other time periods as a heat pump, of the type comprising insulated enclosing means; a space, to be maintained at elevated temperatures, and separated from its surroundings by said enclosing means; heat supplier means, on the inside of said enclosing means; heat absorber means, to exchange heat with said surroundings; and heat pump motivating means to maintain the temperature of said heat supplier means; energy being supplied to said heat pump motivating means in order to maintain the temperature difference between said heat supplier means and said heat absorber means wherein the method comprises constructing said heat exchanger means, which exchange heat with said surroundings, to largely envelop said enclosing means and reducing said temperature difference between said heat supplier means and said heat absorber means substantially (as permitted by said largely enveloping heat exchanger) to the minimum value whereat said enclosing means; said heat exchanger means, on the inside of said enclosing means and said heat exchanger means, to exchange heat with said surroundings and constructed to largely envelop said enclosing means; being surrounded by said surroundings at said temperature of said surroundings, in the absence of other heat absorption means and in the absence of other heat supplier means; could maintain said space, separated from its surroundings by said enclosing means, at said temperatures.

15. The improvement of claim 14, in which, during said refrigeration of said contents of said enclosed space, heat is rejected to the general surroundings; and in which, during said pumping of heat into said contents of said enclosed space, said pumped heat is obtained from said general surroundings.

16. The improvement of claim 14, in which, during said refrigeration of said contents of said enclosed space, heat is supplied to a segregated part of the surroundings, such as a heat storage system; and in which, during said pumping of heat into the contents of said enclosed space, said heat is retrieved from said part of said surroundings.

17. A method for improving the energy efficiency of combination refrigeration and heat pumping processes, for recovering reject heat from refrigerators, typical of residential type appliances, to meet hot water demands, typical of residential type requirements, using enveloping heat exchangers wherein the method comprises the temperature of said hot water being set to only slightly exceed the maximum (user demand) temperature desired by the user, by providing sufficient water storage capacity to meet substantially maximum demand volume, thus reducing the temperature at which heat is rejected from the refrigeration system.

18. The improvement of claim 17, in which the hot water system is segregated into a plurality of heat pumping zones, which are to be a operated at different temperatures thus further reducing the temperature at which heat is rejected from some of the refrigeration systems.

19. A method for increasing the energy efficiency of a refrigeration system of the type comprising insulated enclosing means; a space, to be maintained at depressed temperatures, and separated from its surroundings by said enclosing means; heat absorber means, on the inside of said enclosing means; heat supplier means, to exchange heat with said surroundings and to be maintained at a temperature which is greater than that of said surroundings; and refrigeration motivating means to depress the temperature of said heat absorber means; energy being supplied to said refrigeration motivating means in order to maintain the temperature difference between said heat supplier means and said heat absorber means wherein the method comprises constructing said heat supplier means to largely envelop said enclosing means and reducing said temperature difference between said heat supplier means and said heat absorber means substantially as permitted by said largely enveloping heat supplier, by equiping said refrigeration motivating means to operate at rates which do not substantially exceed needs.

20. A method for increasing the energy efficiency of a heat pumping system of the type comprising insulated enclosing means; a space, to be maintained at elevated temperatures, and separated from its surroundings by said enclosing means; heat supplier means, on the inside of said enclosing means; heat absorber means, to exchange heat with said surroundings; and heat pump motivating means to maintain the temperature of said heat supplier means; energy being supplied to said heat pump motivating means in order to maintain the temperature difference between said heat supplier means and said heat absorber means wherein the method comprises constructing said heat absorber means to largely envelop said enclosing means and reducing said temperature difference between said heat supplier means and said heat absorber means substantially as permitted by said largely enveloping heat absorber, by equiping said refrigeration motivating means to operate at rates which do not substantially exceed needs.

21. A method for increasing the energy efficiency of a combined refrigeration system and heat pumping system of the type comprising insulated enclosing means; a space, to be maintained at depressed temperatures, and separated from its surroundings by said enclosing means; heat absorber means, on the inside of said enclosing means; heat supplier means, thermally connected to said heat pump; further insulated enclosing means; a further space, to be maintained at elevated temperatures, and separated from its surroundings by said further enclosing means; further heat supplier means, on the inside of said further enclosing means; further heat absorber means, thermally connected to said refrigeration system's heat supplier; refrigeration motivating means to depress the temperature of said enclosed heat absorber means and heat pump motivating means to maintain the temperature of said enclosed further heat supplier means; energy being supplied to said refrigeration motivating means in order to maintain the temperature difference between said heat supplier means, and said enclosed heat absorber means and to said heat pump motivating means in order to maintain the temperature difference between said enclosed further heat supplier means and said further heat absorber means, wherein the method comprises constructing first said heat supplier means, to largely envelop first said enclosing means; reducing said temperature difference between said heat supplier means, and said enclosed heat absorber means substantially as permitted by said largely enveloping heat supplier; constructing said further heat absorber means, to largely envelop said further enclosing means and reducing said temperature difference between said enclosed heat supplier means and said further heat absorber means, substantially as permitted by said largely enveloping further heat absorber means, by equiping said refrigeration and heat pump motivating means to operate at rates which do not substantially exceed needs.

22. A method for increasing the energy efficiency of a reversible refrigeration system used, during some time periods as a refrigeration system, of the type comprising insulated enclosing means; a space, to be maintained at depressed temperatures, and separated from its surroundings by said enclosing means; heat absorber means, on the inside of said enclosing means; heat supplier means, to exchange heat with said surroundings and to be maintained at a temperature which is greater than that of said surroundings; and refrigeration motivating means to depress the temperature of said heat absorber means; energy being supplied to said refrigeration motivating means in order to maintain the temperature difference between said heat supplier means and said heat absorber means and during some other time periods as a heat pump, of the type comprising insulated enclosing means; a space, to be maintained at elevated temperatures, and separated from its surroundings by said enclosing means; heat supplier means, on the inside of said enclosing means; heat absorber means, to exchange heat with said surroundings; and heat pump motivating means to maintain the temperature of said heat supplier means; energy being supplied to said heat pump motivating means in order to maintain the temperature difference between said heat supplier means and said heat absorber means wherein the method comprises constructing said heat exchanger means, which exchange heat with said surroundings, to largely envelop said enclosing means and reducing said temperature difference between said heat supplier means and said heat absorber means substantially as permitted by said largely enveloping heat exchanger, by equiping said refrigeration or heat pump motivating means to operate at rates which do not substantially exceed needs.

23. A method for increasing the energy efficiency of a refrigeration system of the type comprising insulated enclosing means; a space, to be maintained at depressed temperatures, and separated from its surroundings by said enclosing means; heat absorber means, on the inside of said enclosing means; heat supplier means, to exchange heat with said surroundings and refrigeration motivating means to depress the temperature of said heat absorber means; energy being supplied to said refrigeration motivating means in order to maintain the temperature difference between said heat supplier means and said heat absorber means wherein the method comprises constructing said heat supplier means to largely envelop said enclosing means and reducing said temperature difference between said heat supplier means and said heat absorber means substantially to the minimum value whereat said insulated enclosing means; said heat absorber means, on the inside of said enclosing means and said heat supplier means, to exchange heat with said surroundings and constructed to largely envelop said enclosing means; being surrounded by said surroundings at said temperature of said surroundings, in the absence of other heat absorption means and in the absence of other heat supplier means; could maintain said space, separated from its surroundings by said enclosing means, at said depressed temperatures.

24. A method for increasing the energy efficiency of a refrigeration system of the type comprising insulated enclosing means; a space, to be maintained at depressed temperatures, and separated from its surroundings by said enclosing means; heat absorber means, on the inside of said enclosing means; heat supplier means, to exchange heat with said surroundings and refrigeration motivating means to depress the temperature of said heat absorber means; energy being supplied to said refrigeration motivating means in order to maintain the temperature difference between said heat supplier means and said heat absorber means wherein the method comprises constructing said heat supplier means to envelop more than half of said enclosing means and reducing said temperature difference between said heat supplier means and said heat absorber means substantially to the minimum value whereat said insulated enclosing means; said heat absorber means, on the inside of said enclosing means and said heat supplier means; being surrounded by said surroundings at said temperature of said surroundings, in the absence of other heat absorption means and in the absence of other heat supplier means; could maintain said space, separated from its surroundings by said enclosing means, at said depressed temperatures.

25. A method for increasing the energy efficiency of a refrigeration system of the type comprising insulated enclosing means; a space, to be maintained at depressed temperatures, and separated from its surroundings by said enclosing means; heat absorber means, on the inside of said enclosing means; heat supplier means, to exchange heat with said surroundings and refrigeration motivating means to depress the temperature of said heat absorber means; energy being supplied to said refrigeration motivating means in order to maintain the temperature difference between said heat supplier means and said heat absorber means wherein the method comprises constructing said heat supplier means to largely envelop said enclosing means.

26. An method for increasing the energy efficiency of a heat pumping system of the type comprising insulated enclosing means; a space, to be maintained at elevated temperatures, and separated from its surroundings by said enclosing means; heat supplier means, on the inside of said enclosing means; heat absorber means, to exchange heat with said surroundings; and heat pump motivating means to maintain the temperature of said heat supplier means; energy being supplied to said heat pump motivating means in order to maintain the temperature difference between said heat supplier means and said heat absorber means wherein the method comprises constructing said heat absorber means to envelop more than half of said enclosing means and reducing said temperature difference between said heat supplier means and said heat absorber means substantially to the minimum value whereat said insulated enclosing means; said heat supplier means, on the inside of said enclosing means and said heat absorber means, to exchange heat with said surroundings; being surrounded by said surroundings at said temperature of said surroundings, in the absence of other heat absorption means and in the absence of other heat supplier means; could maintain said space, separated from its surroundings by said enclosing means, at said elevated temperatures.

27. A method for increasing the energy efficiency of a heat pumping system of the type comprising insulated enclosing means; a space, be maintained at elevated temperatures, and separated from its surroundings by said enclosing means; heat supplier means, on the inside of said enclosing means; heat absorber means, to exchange heat with said surroundings; and heat pump motivating means to maintain the temperature of said heat supplier means; energy being supplied to said heat pump motivating means in order to maintain the temperature difference between said heat supplier means and said heat absorber means wherein the method comprises constructing said heat absorber means to largely envelop said enclosing means.

* * * * *